US006368103B1

(12) United States Patent
Sisco et al.

(10) Patent No.: US 6,368,103 B1
(45) Date of Patent: Apr. 9, 2002

(54) METHOD AND APPARATUS FOR REDUCING EMISSIONS IN KILN EXHAUST

(75) Inventors: Doug Sisco, Eolia; John White; Sam Waters, both of Hannibal, all of MO (US)

(73) Assignee: Continental Cement Company, Hannibal, MO (US)

( * ) Notice: Subject to any disclaimer, the term of this patent is extended or adjusted under 35 U.S.C. 154(b) by 0 days.

(21) Appl. No.: 09/681,289

(22) Filed: Mar. 14, 2001

(51) Int. Cl.[7] ..... F27B 7/32

(52) U.S. Cl. ..... 432/117; 432/103; 110/246; 110/346

(58) Field of Search ..... 432/103, 113, 432/114, 117, 118; 34/201, 202; 110/246, 346

(56) References Cited

U.S. PATENT DOCUMENTS

| | | | | |
|---|---|---|---|---|
| 3,895,936 A | * | 7/1975 | Toepell | 75/29 |
| 4,571,175 A | * | 2/1986 | Bogle et al. | 432/14 |
| 4,730,564 A | * | 3/1988 | Abboud | 432/106 |
| 5,662,050 A | * | 9/1997 | Angelo, II et al. | 110/246 |

* cited by examiner

*Primary Examiner*—Gregory Wilson
(74) *Attorney, Agent, or Firm*—Armstrong Teasdale LLP

(57) ABSTRACT

A method for reducing emissions of a kiln including a feed end, the method includes operating the kiln and spraying a slurry inside the kiln at least five feet from the feed end. Additionally, the kiln includes a substantially tubular body including a bore therethrough. The body has a clinker end, a heat portion, and a feed portion. The kiln further includes a plurality of chains mounted within the bore at the feed portion, a heat source in flow communication with the heat portion, and a spray nozzle mounted in the feed portion away from the feed end.

36 Claims, 3 Drawing Sheets

METHOD AND APPARATUS FOR REDUCING EMISSIONS IN KILN EXHAUST

BACKGROUND OF INVENTION

This invention relates generally to rotary kilns and, more particularly, to reducing emissions including particulate matter in wet process rotary kilns.

Known wet processes include preparing a feed slurry containing up to 40% water. The feed slurry is a substantially homogenous mixture of water and ground material including limestone and clay. The feed slurry is pumped into a feed or cold end of the rotary kilns at a low velocity. Typically, the kilns are tilted at a ratio of approximately 1 foot vertical drop per 30 feet in the horizontal direction and rotate approximately 1 revolution per minute about an axis. The kilns are fitted with suspended chains that act as heat exchangers. The suspended chains are heated by the kiln flue gases. The slurry partially coats the chains as the kiln rotates and due to their large surface area, the chains act to evaporate water from the slurry. The chains also break up a resulting cake into a nodular dry material. The chains are laid out inside the kiln in a pattern extending between 100 to 250 feet. After the cake is broken into the nodular material, calcining and clinkering reactions take place in a calcination and a burning zone of the kiln. The clinker commences to cool down in a burner end of the kiln and discharges into a cooler, where it is cooled by ambient secondary air. The secondary air is preheated by direct contact with the cooling clinker. There is a large quantity of exhaust gasses that form an exhaust stream which flows counter current to the flow of slurry. The exhaust stream typically is at a velocity sufficient to pick up particles of dust and carry the particles out of the kiln. The gasses result from the fuel burned to supply heat as well as gasses released from the calcining and clinkering reactions plus gasses released from physical phase changes i.e., by boiling out of the slurry and nodular pellets.

However, the slurry typically contains trace amounts of organic materials and a conversion of the organic materials to dioxins can occur in an optimum temperature range within the chain section of a kiln or beyond. Accordingly the United States Environmental Protection Agency has proposed Maximum Achievable Control Technologies (MACT) standards regarding reducing emissions by reducing operating temperatures within rotary kilns.

SUMMARY OF INVENTION

A slurry of ground materials and water flows down a feed chute into a feed end of a kiln. A portion of the slurry in the feed chute is diverted by a flow control valve and is pumped through a pipe to a nozzle at a pressure sufficient to spray the slurry and coat a chain end and an inside diameter of a body of the kiln. The sprayed slurry creates a dust curtain that encapsulates particles of dust and rapidly cools the exhaust stream. Accordingly, the amount of dust and dioxins in the exhaust at the feed end is less with the nozzle spraying slurry than without the nozzle.

DETAILED DESCRIPTION

Figure 1:
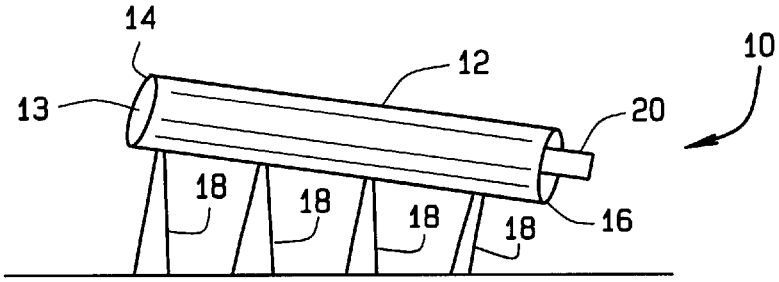
FIG. 1 is a perspective view of a rotary kiln.

FIG. 1 is a perspective view of a rotary kiln 10 including a substantially tubular body 12 including a bore 13 therethrough. Body 12 further includes a feed end 14 and a clinker end 16. Body 12 is mounted on a plurality of mounts 18 such that feed end 14 is higher than clinker end 16 and body 12 slopes approximately 0.375 inches vertically per 1 foot horizontal. Kiln 10 further includes a heat source 20 that provides heat to body 12. It is contemplated that the benefits of the invention accrue to all rotary kilns of varying lengths and varying slopes.

Figure 2:
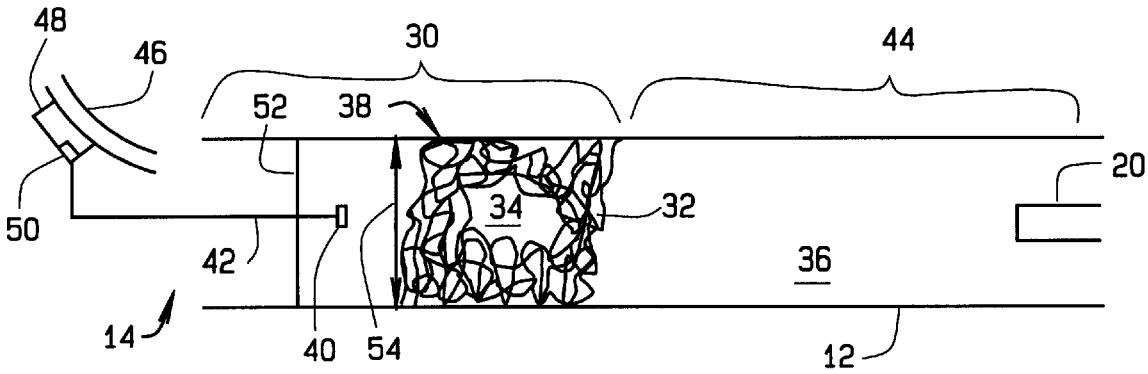
FIG. 2 is a perspective view, with parts cut away, of the kiln shown in FIG. 1.

FIG. 2 is a perspective view, with parts cut away, of kiln 10 shown in FIG. 1. Body 12 includes a feed portion 30 extending from feed end 14 to a chain first end 32. A plurality of chains 34 are mounted to an interior surface 36 of body 12 starting at chain first end 32 and ending at a chain second end 38. Kiln 10 further includes a spray nozzle 40 in flow communication with a slurry pipe 42 that extends out feed end 14. Slurry pipe 42 extends in body 12 at least five feet so that nozzle 40 is at least five feet within feed end 14. In one embodiment, nozzle 40 is at least twelve feet within feed end 14. In another embodiment, nozzle 40 is at least twenty-five feet within feed end 14. In an exemplary embodiment, chain second end 38 is fabricated of chains 34 such that a chain density is between 10 and 23 pounds per cubic foot utilizing chains with a chain link size of approximately 0.88 inch and a chain link diameter of approximately 3 inches. In an alternative embodiment, the chain density at chain second end 38 is between 14 and 20 pounds per cubic foot. In a further alternative embodiment, the chain density is approximately 17 pounds per cubic foot. Chains 34 which are mounted away from chain second end 38 are of known type and are arranged in known configuration. Kiln 10 further includes a heated portion 44 in flow communication with heat source 20. A feed chute 46 is in flow communication with feed end 14 and includes a flow control valve 48 including a pump 50 in flow communication with slurry pipe 42. Slurry pipe 42 is rotatably supported by a spider frame 52. In an alternative embodiment, slurry pipe 42 is supported by more than one spider frame 52.

During operation of kiln 10, a slurry (not shown) of ground materials and water flows down chute 46 into feed end 14. Body 12 rotates causing the slurry to spiral along interior surface 36 in a downward fashion. However, some of the slurry in feed chute 46 is diverted by flow control valve 48 and pumped through slurry pipe 42 to nozzle 40 at a pressure sufficient such that the slurry is sprayed spreading in a semi-conical shape to coat an inside diameter 54 of body 12. In an exemplary embodiment, inside diameter 54 is located at chain second end 38 and, accordingly, chain second end 38 is substantially completely coated with slurry. In an alternative embodiment nozzle 40 is an open end (not shown in FIGS. 1 and 2) of slurry pipe 42 and a diameter of slurry pipe 42 is sufficient to spray slurry to substantially completely coat chain second end 38. In one embodiment, at least 30% of the slurry in feed chute 46 is diverted by flow control valve 48. In another embodiment, approximately 60% of the slurry in feed chute 46 is diverted by flow control valve 48.

As the slurry moves through chains 34 the slurry is heated from about 60° Fahrenheit (F) up to about 2000° F. and the slurry leaves chains 34 as small pellets. The temperature of the pellets continue to rise as the pellets approach clinker end 16. Since the pellets are substantially dehydrated, and the pellets are being tumbled downward, a large quantity of dust (not shown) is generated. Counter to this downward flow of slurry and pellets, is an upward flow of gasses forming an exhaust stream. The exhaust stream is at a sufficient velocity to pick up dust including dioxins.

The sprayed slurry creates a dust curtain that encapsulates particles of dust and removes the particles of dust from the exhaust stream. Additionally, the sprayed slurry rapidly cools the gases to a temperature less than 400° F. and facilitates a reduction in the conversion of raw materials into dioxins. Accordingly, it has been determined that the emissions leaving kiln 10 at feed end 14 is less with nozzle 40 spraying a slurry than without nozzle 40.

Figure 3:
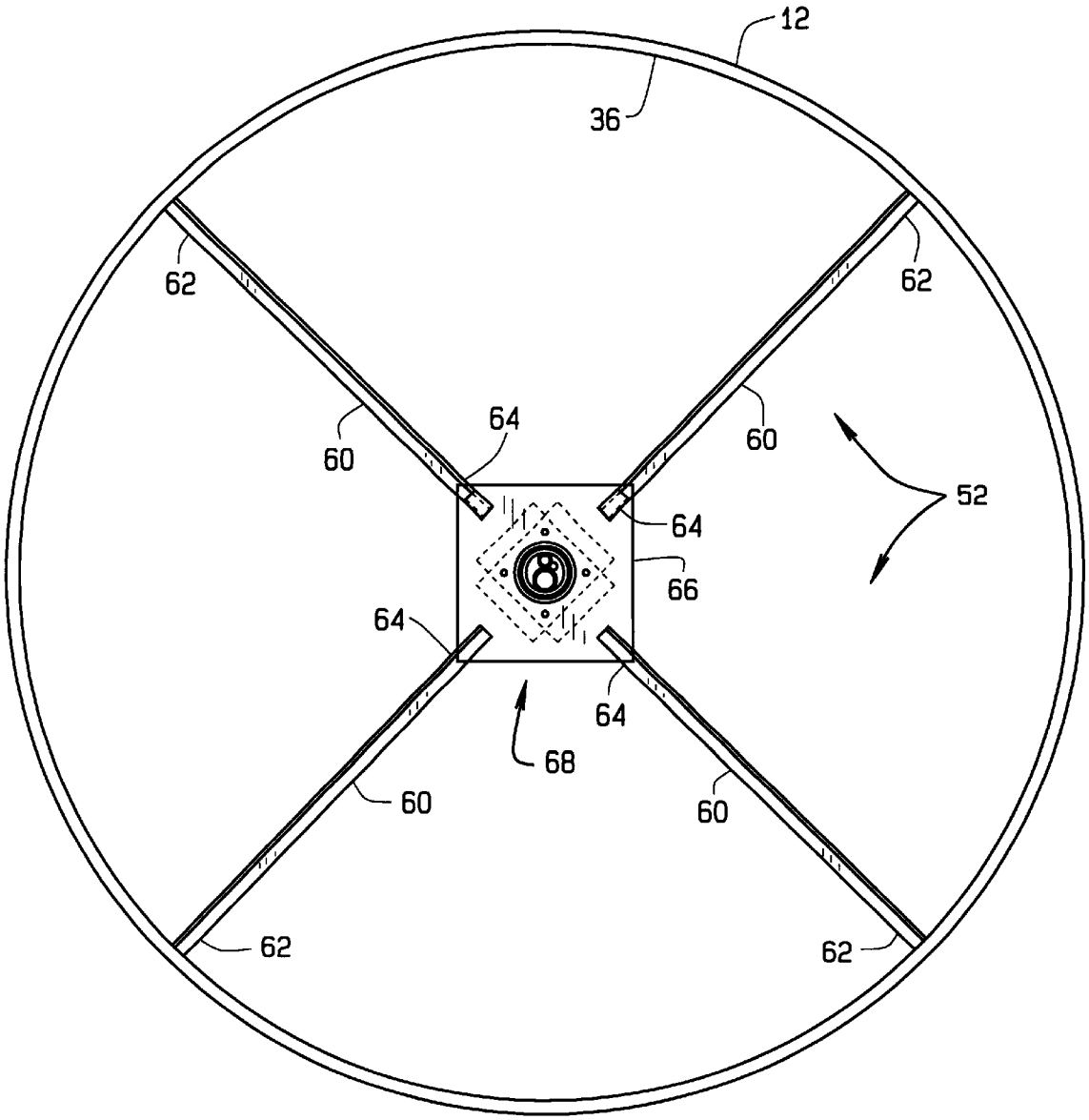
FIG. 3 is an interior longitudinal view of the spider frame shown in FIG. 2.

FIG. 3 is an interior longitudinal view of spider frame 52 (shown in FIG. 2) including a plurality of spider members 60 mounted to interior surface 36 at first ends 62 approximately equally spaced circumferentially. Spider members 60 include seconds ends 64 attached to a wear block fixture 66 which is substantially centered within body 12. Wear block fixture 66 includes an aperture 68.

Figure 4:
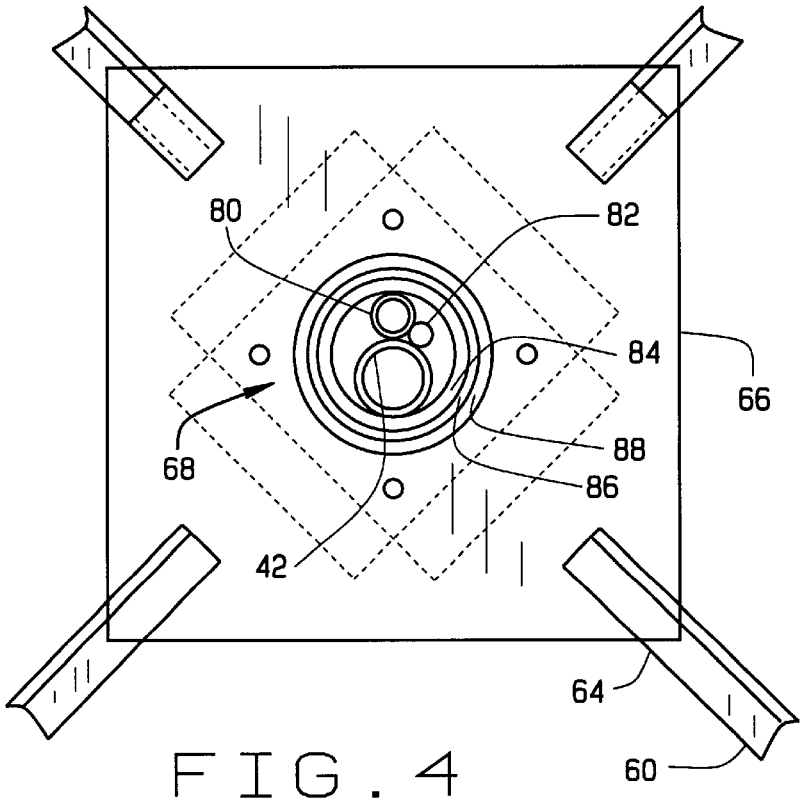
FIG. 4 is a detailed longitudinal view of the wear block fixture shown in FIG. 3.

FIG. 4 is a detailed longitudinal view of wear block fixture 66 (shown in FIG. 3). Slurry pipe 42 (shown in FIG. 2) is positioned within aperture 68. Aperture 68 further has an air pipe 80 and a water pipe 82 positioned therein. Slurry pipe 42, air pipe 80, and water pipe 82 are surrounded by a sleeve 84. In one embodiment, sleeve 84 is coated with a nickel-chromium-boron (NCB) coating. Sleeve 84 is rotatably positioned inside a wear block 86 that is attached to a wear block mounting plate 88 which is attached to wear block fixture 66.

Figure 5:
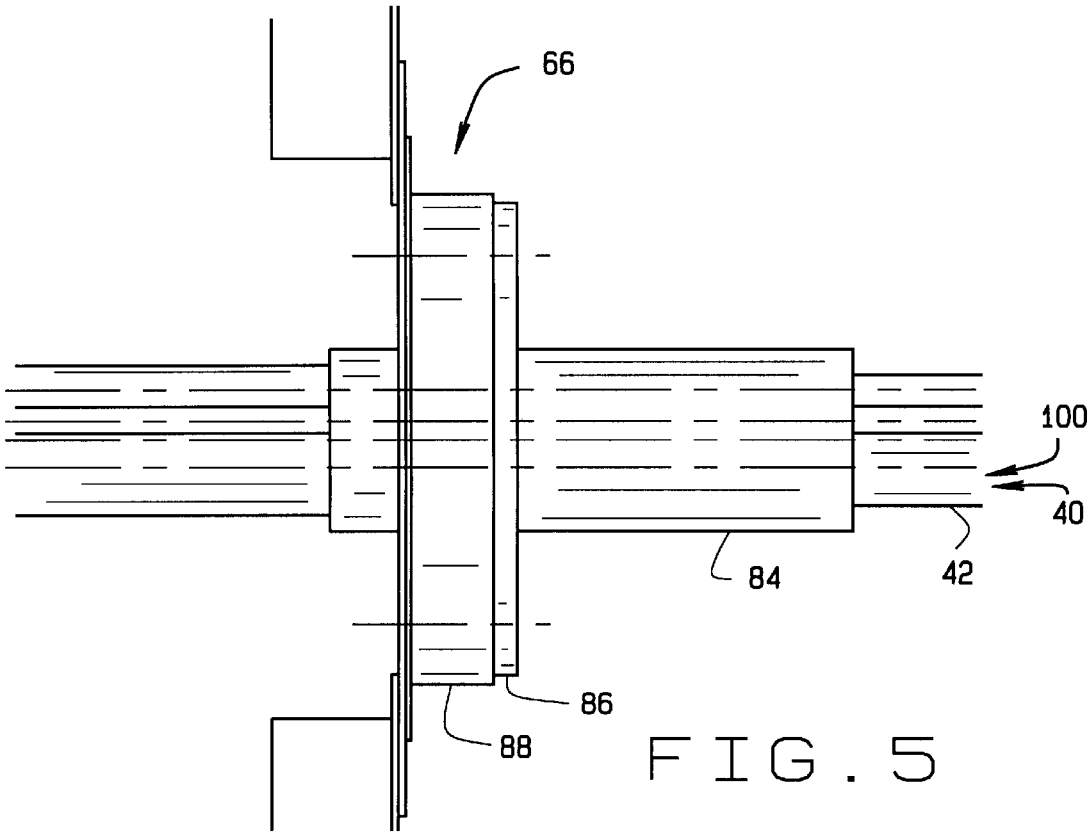
FIG. 5 is a detailed side view of the wear block fixture shown in FIGS. 3 and 4.

FIG. 5 is a detailed side view of wear block fixture 66 (shown in FIGS. 3 and 4). Slurry pipe 42 extends from sleeve 84 and an open end 100 forms nozzle 40 (shown in FIG. 2). Sleeve 84 is positioned rotatably within wear block 86 attached to wear block mounting plate 88.

During operation of kiln 10, body 12 rotates causing wear block 86 to rotate. However, sleeve 84 does not rotate and, accordingly, slurry pipe 42, water pipe 82, and air pipe 80 do not rotate. Slurry pipe 42 delivers a spray of slurry as explained above, and a dust curtain is created at chain second end 38. The curtain removes particles of dust from the exhaust stream and emissions are thus lowered compared to a kiln that does not create a dust curtain at a chain end. In addition, water (not shown) is delivered through water pipe 82 and air pipe 80 supplies air (not shown) to mist the water to cool the gasses more than the slurry cools the gasses. In an alternative embodiment, aperture 68 has neither water pipe 82 nor air pipe 80 positioned therein and only the slurry cools the gasses.

While the invention has been described in terms of various specific embodiments, those skilled in the art will recognize that the invention can be practiced with modification within the spirit and scope of the claims.

What is claimed is:

1. A method for operating a kiln, said method comprising the steps of:

operating the kiln including a feed end;

spraying a slurry inside the kiln at least five feet from the feed end; and wetting a chain with the sprayed slurry.

2. A method according to claim 1 wherein said step of spraying a slurry further comprises the step of spraying a slurry inside the kiln at least twelve feet from the feed end.

3. A method according to claim 1 wherein said step of spraying a slurry further comprises the step of spraying a slurry inside the kiln at least twenty-five feet from the feed end.

4. A method according to claim 1 wherein said step of spraying a slurry further comprises the step of spraying a slurry covering an inside diameter of the kiln.

5. A method according to claim 1 wherein said step of wetting a chain further comprises the step of wetting a chain end having a chain density of between 10 and 23 pounds per cubic foot.

6. A method according to claim 5 wherein said step of wetting a chain end further comprises the step of wetting a chain end having a chain density of between 14 and 20 pounds per cubic foot.

7. A method according to claim 6 wherein said step of wetting a chain end further comprises the step of wetting a chain end having a density of approximately 17 pounds per cubic foot.

8. A method according to claim 1 wherein said step of spraying a slurry further comprises the step of covering an inside diameter of the kiln with the sprayed slurry to substantially coat a chain end.

9. A method according to claim 1 wherein said step of spraying a slurry further comprises the step of spraying a slurry with a spray nozzle which does not rotate with the kiln.

10. A method according to claim 1 further comprising the step of diverting at least 30% of a slurry entering the kiln to a slurry pipe.

11. A method according to claim 1 further comprising the step of diverting approximately 60% of a slurry entering the kiln to a slurry pipe.

12. A method according to claim 1 wherein said step of spraying a slurry further comprises the step of spraying a slurry from a slurry nozzle including at least one of an air pipe and a water pipe.

13. A method according to claim 12 wherein said step of spraying a slurry further comprises the step of spraying a slurry from a slurry nozzle including an air pipe and a water pipe.

14. A method according to claim 1 wherein said step of spraying a slurry further comprises the step of spraying a slurry to cool an exhaust stream to less than 400 F.

15. A system for reducing emissions of a rotary kiln including a feed end, said system comprising:

a spray nozzle positioned within the kiln at least five feet from the feed end;

a pipe in flow communication with said spray nozzle and configured to supply said spray nozzle with a slurry; and a chain extending into the kiln, said spray nozzle configured to spray said chain.

16. A system according to claim 15 wherein said spray nozzle positioned within the kiln at least twelve feet from the feed end.

17. A system according to claim 15 wherein said spray nozzle positioned within the kiln at least twenty-five feet from the feed end.

18. A system according to claim 15 wherein said spray nozzle configured to spray the slurry to cover an inside diameter of the kiln.

19. A system according to claim 15 wherein said spray nozzle configured to wet an end of said chain extending into the kiln.

20. A system according to claim 19 wherein said spray nozzle further configured to wet a chain end having a chain density of between about 10 and 23 pounds per cubic foot.

21. A system according to claim 19 wherein said spray nozzle further configured to wet a chain end having a chain density of between about 14 and 20 pounds per cubic foot.

22. A system according to claim 19 wherein said spray nozzle further configured to wet an end of said chain having a density of approximately 17 pounds per cubic foot.

23. A system according to claim 15 wherein said spray nozzle configured to cover an inside diameter with a slurry to coat a chain end.

24. A system according to claim 15 further comprising:

at least one spider frame mounted inside the kiln; and a wear block mounted on said spider frame, said wear block supporting said pipe.

25. A system according to claim 24 further comprising:

a plurality of spider frames mounted inside the kiln; and a wear block mounted on each said spider frame, each said wear block supporting said pipe.

26. A system according to claim 24 wherein said wear block is mounted on said spider frame such that said pipe is substantially centered within the kiln.

27. A system according to claim 24 further comprising at least one of an air pipe and a water pipe rotatably mounted in said wear block.

28. A system according to claim 24 further comprising:

an air pipe rotatably mounted in said wear block; and a water pipe rotatably mounted in said wear block.

29. A system according to claim 15 wherein said pipe further configured to supply said spray nozzle with a slurry to cool an exhaust stream to less than 400° F.

30. A kiln comprising:

a substantially tubular body comprising a feed end, a clinker end, a heat portion, a feed portion, and a bore extending from said feed end to said clinker end, said feed portion distanced from said feed end;

a plurality of chains mounted within said bore at said feed portion;

a heat source in flow communication with said heat portion; and a spray nozzle mounted in said bore at said feed portion.

31. A kiln according to claim 30 wherein said plurality of chains mounted at least 20 feet from said feed end, said spray nozzle mounted at least 5 feet from said feed end.

32. A kiln according to claim 30 further comprising a pipe in flow communication with said spray nozzle.

33. A kiln according to claim 30 wherein said pipe extends out said feed end.

34. A kiln according to claim 30 further comprising:

at least one spider frame mounted in said bore;

a wear block mounted on said spider frame; and a pipe rotatably mounted in said wear block, said spray nozzle mounted on said pipe.

35. A kiln according to claim 34 further comprising at least one of an air pipe and a water pipe rotatably mounted in said wear block.

36. A kiln according to claim 35 further comprising an air pipe and a water pipe rotatably mounted in said wear block.

* * * * *